US007075253B2

(12) United States Patent
Huber

(10) Patent No.: US 7,075,253 B2
(45) Date of Patent: Jul. 11, 2006

(54) METHOD FOR OPERATION OF A LIGHTING SYSTEM

(75) Inventor: Andreas Huber, Traunreut (DE)

(73) Assignee: Patent-Treuhand-Gesellschaft für elektrische Glühlampen mbH

( * ) Notice: Subject to any disclaimer, the term of this patent is extended or adjusted under 35 U.S.C. 154(b) by 136 days.

(21) Appl. No.: 10/845,139

(22) Filed: May 14, 2004

(65) Prior Publication Data

US 2004/0232852 A1 Nov. 25, 2004

(30) Foreign Application Priority Data

May 22, 2003 (DE) ..... 103 23 752

(51) Int. Cl.
*G05F 1/00* (2006.01)

(52) U.S. Cl. ..... 315/307; 315/360; 315/209 R; 315/289; 315/106; 315/DIG. 7

(58) Field of Classification Search ..... 315/94, 315/97, 105, 106, 194, 209 R, 291, 278, 315/289, 307, 308, 360, DIG. 5, DIG. 7
See application file for complete search history.

(56) References Cited

U.S. PATENT DOCUMENTS

| | | | | |
|---|---|---|---|---|
| 5,315,214 | A * | 5/1994 | Lesea | 315/209 R |
| 5,691,605 | A * | 11/1997 | Xia et al. | 315/307 |
| 6,717,374 | B1 * | 4/2004 | Krummel | 315/291 |
| 2004/0232856 | A1 * | 11/2004 | Huber | 315/291 |
| 2004/0245943 | A1 * | 12/2004 | Huber | 315/291 |

* cited by examiner

*Primary Examiner*—Haissa Philogene
(74) *Attorney, Agent, or Firm*—Kenneth D. Labudda

(57) ABSTRACT

In an operating method for a lighting system and a lighting system in which a readiness command is provided, in response to such readiness command a ballast drives a discharge lamp in such a way that it heats the electrodes further if the discharge lamp is not burning, so that a controller can use a switch-on command to reignite the discharge lamp without delay by means of a preheating time.

4 Claims, 6 Drawing Sheets

METHOD FOR OPERATION OF A LIGHTING SYSTEM

TECHNICAL FIELD

The present invention relates to a method for operation of a lighting system and, in addition, also to correspondingly equipped ballasts, controllers and lighting systems.

The present invention relates more specifically to a lighting system which contains at least one gas discharge lamp with preheatable electrodes. In many discharge lamp types, electrodes can be preheated in order to improve the starting conditions and to lengthen the life of the discharge lamp. A discharge lamp such as this is switched on via a preheating process and a subsequent starting process in the lamp.

In addition to a number of lamps, of which at least one is a gas discharge lamp with preheatable electrodes, the lighting system which is considered by the invention also has at least one controller for the signaling drive for at least one ballast, which is connected to the discharge lamp, via appropriate commands.

BACKGROUND ART

Lighting systems having two or more lamps for light production are generally used in particular for indoor illumination as well as for other application areas. In lighting systems such as these, the operation of the individual lamps is controlled, in particular with the individual lamps switched on and off, in widely differing manners.

DISCLOSURE OF THE INVENTION

The invention is based on the technical problem of specifying an improved operating method for a lighting system such as this.

The invention is based on a method such as this in which the controller sends a readiness command to the ballast, in response to which the ballast drives the discharge lamp in such a way that it heats the electrodes further if the discharge lamp is not burning, such that the controller can use a switch-on command to reignite the discharge lamp, whose electrodes are heated, without delay by means of a preheating time.

In addition, the invention is also based on an appropriately designed ballast as well as a controller and a lighting system which is designed with appliances such as these and is designed for the method.

Preferred refinements of the invention are specified in the dependent claims. The individual features in this case relate both to the apparatus category and to the method category of the invention.

In some applications, it has been found that the delay caused by the preheating time between a switch-on command and the actual production of light may be disadvantageous. This relates in particular to the field of stage and effect lighting, but may also be of interest in other contexts, particularly in the case of relatively complex time control schemes.

The invention accordingly provides a readiness state for the ballast and in consequence for the discharge lamp, in which the electrodes continue to be heated. The further heating is carried out at least to the extent that restarting can be carried out without damage to the lamp and with virtually no time delay. This readiness state is brought about by sending a readiness command, which is provided for this purpose, from the controller to the ballast. The readiness command may on the one hand result in the ballast not implementing a subsequent switch-off command in the sense of switching off completely but in the sense of changing to the readiness state, that is to say with the electrodes still being heated although the discharge lamp is not burning. On the other hand, the readiness command may, however, also be received when the lamp is switched off, and may result in preheating or heating the electrodes until the next switch-on command with a corresponding immediate start. Thirdly, and this variant is preferred for the invention, the readiness command at the same time acts as a switch-off command, that is to say it is sent to a ballast of a burning discharge lamp, in response to which the discharge lamp goes out, although the electrodes are still heated.

Thus, overall, the invention has the advantage that the introduction of a further command and of a corresponding readiness state allows virtually instantaneous immediate starting of discharge lamps in lighting systems when required.

It is also possible to provide for the readiness state or electrode heating process which follows the readiness command to be limited in time and to be switched off again when no switch-on command or else a renewing further readiness command is received within a predetermined time. This makes it possible to prevent the readiness state from lasting for an unnecessary time or even an unlimited time in the event of an incorrect control action or unexpected ending of operation of the lighting system.

This time limit is preferably provided by the ballast rather than by the controller. In this context, it is also possible to provide for a check to be carried out with the ballast when a switch-on command occurs in order to determine whether the readiness state, that is to say the electrode heating process, is still continuing. A preheating process can then be inserted, or not inserted, before restarting, depending on the result of the check. This check is also preferably carried out by the ballast itself, thus checking the state of the lamp being operated by it, and/or its own operating state.

Furthermore, it is possible for the invention to provide for the capability to end the readiness state even before the time limit has elapsed or, if this feature is not provided, to be ended completely by means of a readiness-off command.

A ballast according to the invention is designed in an appropriate manner, that is to say it is designed to react to the readiness command according to the invention in the described manner.

A controller according to the invention is in turn designed to be able to send a described readiness command, that is to say to provide the relevant additional command. Furthermore, a lighting system according to the invention has at least one corresponding ballast and at least one corresponding controller in order to make it possible to operate in accordance with the described method.

When a lighting system according to the invention is being installed, an association must be made between the positions of the individual lamps and/or lamp groups which are operated from a common equipment, and their address. In plain words, the controller must therefore know what address is to be driven when the aim is to influence the operation of a specific lamp or lamp group.

In this context, the invention also includes the aspect of providing the ballasts, before installation in the lighting system, with codes which are specific for the respective ballasts and can be externally addressed by signaling, for these codes to be read during the installation of the lighting system and to be entered into the controller, so that they can be associated by the controller with the installation positions of the respective ballasts with the controller assigning respective drive addresses for drive purposes to each of the ballasts, and the controller controlling the ballasts using the drive addresses.

However, in addition, the invention also relates to a lighting system which is manufactured and operated in a corresponding manner as well as, finally, to a production method for a ballast, in which the ballast is provided in a manner matched to the invention with a code which can be externally addressed by signaling.

The major aspect here is the individual coding of ballasts in order to make it possible to distinguish between different ballasts during installation of the lighting system. Conventionally, the ballasts can in principle not be distinguished from one another—irrespective of whether they are now designed autonomously or intrinsically as a module with a lamp. For example, when allocating a ballast address in the controller, the fitter must therefore use the controller to drive the appropriate ballast and actually check which lamp or lamps has or have been switched on. This is the only way in which it is possible to make the association between the address and the position in the lighting system. This can be extraordinarily tedious in the case of relatively large lighting systems or in the case of lighting systems which are distributed over a number of rooms or even buildings.

In contrast, the invention provides for the code to be read, that is to say to be recorded in some manner, during the installation of lighting system, that is to say while the ballast is being fitted, in order to make it possible to enter the code together with the installation position in the controller. For example, when fitting the ballast, the fitter can write down a code which is written on it and can produce an installation plan appropriately annotated with codes, which may be used during the programming of the controller. However, he can also type the code into a file or, for example, read it with a barcode reader or record it as data or electrically in some other manner. When the controller is now programmed, an association already exists between the codes for the ballasts and their positions in the lighting system, because the fitter has actually created this association while fitting the ballasts, that is to say at this time with knowledge of the positions in the lighting system.

The controller now just has to assign the respective ballasts to drive addresses, which could also be the codes themselves and which in future address and control the ballasts by means of these drive addresses.

The preceding text has referred to ballasts and not to lamps, although, in the end, the aim is to control lamp operation in the lighting system. However, pure lamps without a ballast cannot be addressed per se. It is assumed that the expression ballast in this case means the equipment which is, so to speak, associated directly with the lamps, that is to say those appliances which are connected to the lamps only via electrical cables or other simple electrical devices without their own data function and significance. This therefore relates to ballasts which are connected directly to the lamps.

This does not prevent appliances which are connected indirectly to the lamps, that is to say appliances which are themselves in turn connected to the lamps via ballasts, also having the capability to be addressed and to be coded in the manner according to the invention.

The connections between the controller and the ballasts may also be provided without the use of cables, that is to say for example being based on radio links. Furthermore, the expression lighting system should in this case be understood in a very general manner and is not restricted to illumination systems in the traditional sense, that is to say the examples mentioned initially of room or external lighting by means of conventional lamps. The expression "can be externally addressed by signaling" should likewise be understood in a general manner and may on the one hand mean that the codes in the ballasts can be read from the outside, so that the controller or a servicing appliance can check the code for a ballast. However, "can be addressed" may also mean that the ballasts can be selected on a code-specific basis, that is to say that the appropriate ballast "feels addressed" when a drive command with the relevant code is received.

The method according to the invention thus has the advantage of clear installation and address association involving comparatively little labor effort. These advantages also apply, of course, to the lighting system which is produced and operated in a corresponding manner. As a result of their applicability to the described production method, these advantages also apply to the matching ballasts and thus to a production method for a ballast in which a ballast which can be integrated in the manner described above in a lighting system that is controlled by addresses is provided in the sense mentioned above with a code which can be externally addressed by signaling.

One preferred embodiment of the invention provides for the codes of the ballasts to be externally addressable via cables at the ballasts, with these cables connecting the ballasts to the controller. Apart from conventional electrical cables, these cables may, however, also be optical cables, for example glass fiber cables.

The codes which are contained in the ballasts may preferably be stored there in a semiconductor memory. Furthermore, according to the invention, they may preferably be applied to the ballast in a manner which allows them to be read optically, that is to say, for example, in the described manner as a bar code printed or stuck on it, or as an alphanumeric inscription.

More complex control capabilities for lighting systems are demanded in particular in the field of indoor illumination, so that the invention is preferably aimed at this area. Examples include conference rooms and function rooms, theaters and the like.

The lighting system according to the invention may itself be part of a larger system, and the controller may thus itself be connected to a building control system for more general building control purposes, and may be controlled by this system. The functional commands associated with the addressing that has been mentioned may in this case, of course, in the end be produced by the building control system and may just be entered by the lighting system controller in the lighting system.

The invention also allows an existing lighting system to be upgraded in a particularly simple manner. The method according to the invention thus also covers the situation in which an existing lighting system is being upgraded by the addition of at least one ballast, and is thus produced in the upgraded form. In this case, not only is the situation in which the previously relatively small lighting system was intrinsically designed according to the invention feasible, but so is the situation in which a conventional lighting system is made compatible with the method according to the invention by appropriate retrofitting or replacement of the controller. The conventional relatively small lighting system then in fact already has an address association so that the advantages of the invention can be used for the present or else future upgrade steps.

One type of ballast coding, which is simple and is advantageous in particular for subsequent fault tracing, complaints or for statistical data recording, is for the code to include the date and/or the location of manufacture of the ballast and/or details about the ballast type, the lamp type which can be connected or the number of lamps which may be connected, or else exclusively to comprise only these details. This also allows the relevant ballasts to be selected in a particularly simple manner in this way for subsequent retrofitting, for example for software updates in microcontroller control systems or when searching for system parts to be replaced or to be checked.

In the case of this invention, the ballast and the controller should preferably be designed for digital communication, that is to say the ballast should be digitally controllable using a communication protocol, and the controller should be designed with a communication protocol for digitally driving a ballast. In particular, different manufacturers have recently agreed on a common communication protocol entitled "digital addressable lighting interface" (="DALI").

A further aspect of the invention provides for the ballast to be driven digitally by means of a second additional communication protocol.

This additional aspect of the invention thus comprises offering particular advantages in designing the appliances which have been mentioned for two different communication protocols, with the expression appliance in the following text meaning both the controller and the ballast according to the invention. In addition to a predetermined protocol, for example the DALI protocol that has been mentioned, an appliance according to the invention may thus then communicate and interchange further information in a corresponding manner via an additional protocol.

In addition to the pure extension of the communication options beyond the increase in the technical performance provided by the first communication protocol, the invention in this case has the considerable advantage that this performance improvement can be achieved without contravening a predetermined protocol which is widely used where possible in practice and/or is defined by specific standardization. This is because the appliances according to the invention are still compatible with the first protocol. One additional aspect may be for the second communication protocol to be defined (in contrast to a first protocol which is standardized on the basis of manufacture agreement or in some other way) on a manufacturer-specific basis or, in individual cases, even on an application-specific or customer-specific basis, and possibly also to be modified and, in particular, upgraded, with little effort or at relatively short time intervals.

In this case, however, the unrestricted functionality of the communication via the first protocol is maintained, that is to say in particular the capability to create and understand the associated commands correctly. Instead of replacing a protocol that is to be modified or to be upgraded in a manner which is technically in principle simpler and more direct by another, the invention thus adopts the approach of "double-tracked" communication between the appliances.

The appliances according to the invention are, of course, preferably provided in combination. The invention is thus also aimed in particular at lighting systems in which both the ballasts and the controllers are designed according to the invention. On the other hand, advantages are achieved just by only a single appliance corresponding to the invention or just by the ballasts or controllers, or some of them in a lighting system, corresponding to the invention. Firstly, this results in an improved retrofitting capability and functional upgrading by subsequent connection of matching appliances according to the invention (controllers for existing ballasts or vice versa). Secondly, the individual appliances can be read or reprogrammed by an external servicing appliance which is designed for the second communication protocol, without in this case having to be restricted by the first protocol.

A ballast according to the invention is in this case preferably designed such that, on receiving a drive signal, it is autonomously possible to find out the communication protocol with which the drive signal is associated and to appropriately set evaluation of this drive signal. However, in principle, the invention could also be implemented in such a way that the ballast can be switched from the first communication protocol to the second, or vice versa, by an external signal or a switch on the ballast, or in some similar manner.

A controller according to the invention is once again preferably equipped such that it can send drive signals in accordance with the first communication protocol and further drive signals in accordance with the second communication protocol "at the same time". In this case "at the same time" means that the signals are sent without switching by any external effect, that is to say either actually in parallel, for example at different carrier frequencies, or interleaved in time in some manner, that is to say alternating after specific numbers of bits or specific numbers of commands. In particular, it is preferable for the controller to send drive signals interleaved in time in accordance with both communication protocols, with the signals alternating on a command basis without any fixed predetermined alternation sequence. The alternation in this case takes place as necessary. Thus, for example, commands in the second protocol are inserted as required between commands in the first protocol. In this case, the already mentioned preferred ballast may provide the association with the protocols autonomously.

One preferred possible way to distinguish between the protocols is for the corresponding command words to have different word lengths. However, the command words preferably have identical start bits in order to allow synchronization or triggering first of all. Furthermore, as an alternative to different word lengths or additionally, it is possible to provide for the communication protocols to be distinguished by their stop bits. The use of the two distinction options at the same time ensures better identification reliability.

Furthermore, the communication protocols according to the invention are preferably biphase-coded. This means that the logic 1 and the logic 0 do not correspond to an electrical low level or high level, or vice versa, but to a predetermined level change. For example, a rising sudden level change may represent a logic 0, and a falling sudden level change may represent a logic 1, and vice versa. This has the advantage that the presence of a bit can be identified unambiguously. In this context, reference should also be made to EP 1 069 690.

One particularly useful application of the invention is for appliances according to the invention to be able to use the second communication protocol, for example the manufacturer-specific protocol, for reading relating to defect analysis or previous operating histories, and for reprogramming for maintenance and/or updating. In particular, the content of an electronic memory in a microcontroller control system may be read, for example, for the number of operating hours or false messages, or may have more up-to-date operating software written to it, or operating software matched to a newly used lamp type. Finally and in particular, the comprehensively described readiness commands and readiness-off commands (which are not provided, for example, within the scope of the DALI protocol) may be used for the additional communication protocol.

BEST MODE FOR CARRYING OUT THE INVENTION

The invention will be explained in more detail in the following text with reference to an illustrative exemplary embodiment, with reference being made to the attached figures. In this case, the disclosure, as well as the above description itself, relates both to the apparatus character and to the method character of the invention. The individual features may also be significant to the invention in other combinations.

Figure 1:
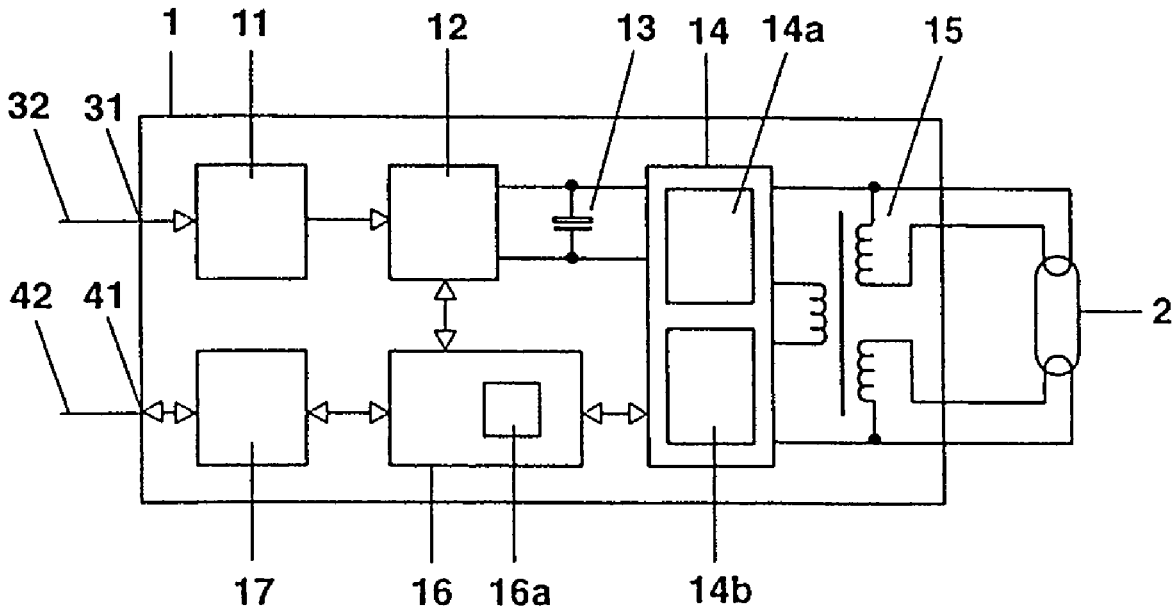
FIG. 1 shows a schematic block diagram of a ballast according to the invention.

FIG. 1 shows a schematic block diagram of a ballast according to the invention for a discharge lamp in a lighting system.

The discharge lamp, which is annotated 2, is started and operated by the electronic ballast, which is annotated 1, and, in particular, has preheatable electrodes. The electronic ballast on the one hand has a mains connection 31 for connection of a mains supply cable 32, and on the other hand has a control connection 41 for connection of a control cable 42.

Conventional devices are described per se only cursorily in the following text, because those skilled in the art will be familiar with their technical design in any case and they are only of secondary importance for understanding of the invention.

The mains connection 31 passes via a radio suppression filter 11 and a rectifier with a power factor correction circuit (PFC circuit) to a smoothing capacitor 13, which supplies DC power to an inverter 14, for example based on half-bridge topology. The functional blocks of the inverter 14 are essentially a lamp circuit 14*a* and a heating circuit 14*b*, and the inverter 14 is connected to the lamp 2 via a transformer 15 with taps for heating the electrodes (as indicted graphically).

On the other hand, the control connection 41 is connected to a digital electronic interface 17, and supplies a control signal via the interface 17 to a microcontroller 16 with a memory 16*a*. This microcontroller 16 is used to control the inverter, that is to say in the end to control the lamp including preheating, starting and the dimming function.

FIG. 2 once again schematically shows a lighting system according to the invention, with 1-11 to 1-*n* and 1-21 to 1-*m* denoting electronic ballasts of the type illustrated in FIG. 1, and 2-11 to 2-*n* and 2-21 to 2-*m* denoting discharge lamps connected to them, corresponding to the lamp 2 shown in FIG. 1. The dashed horizontal line which is shown approximately in the center of FIG. 2 symbolically divides a first room, which is located above it, from a second room, which is located below it. Some of the electronic ballasts and lamps are thus located in the first room, while others are located in the second room. In reality, of course, further rooms, and possibly also further electronic ballasts and lamps as well, are provided, so that FIG. 2 may be regarded as continuing downwards. Control elements for operating the lighting system are provided at 7*a* and 7*b* in the left-hand area, with the control elements being connected to two controllers 3*a* and 3*b*. In this example, both controllers are located in the first room, where the control elements 7*a* and 7*b* are also located, at the top on the left. However, an identical second control element 7*a*, which is interconnected to the upper control element 7*a* and operates identically, is also located in the second room. The controller 3*a* thus carries out functions which can be controlled from both rooms, while the controller 3*b* is accessible only in the first room.

The controllers 3*a* and 3*b* are connected by means of control signal outputs to two bus signal lines 42, whose branches correspond to the control line 42 shown in FIG. 1. The control signal line 42 thus has two poles and is in the form of a pure bus line, because the two controllers 3*a* and 3*b* as well as all the electronic ballasts are connected to it. The mains power supply 32 from each of the electronic ballasts is not shown in FIG. 2, and is provided locally on the basis of principles which are not of interest to the invention. It is thus clear that functions of the individual lamps and electronic ballasts can be controlled purely by signaling via a bus line 42, via the control elements and controllers, and the control signals will be described in more detail below.

Figure 2:
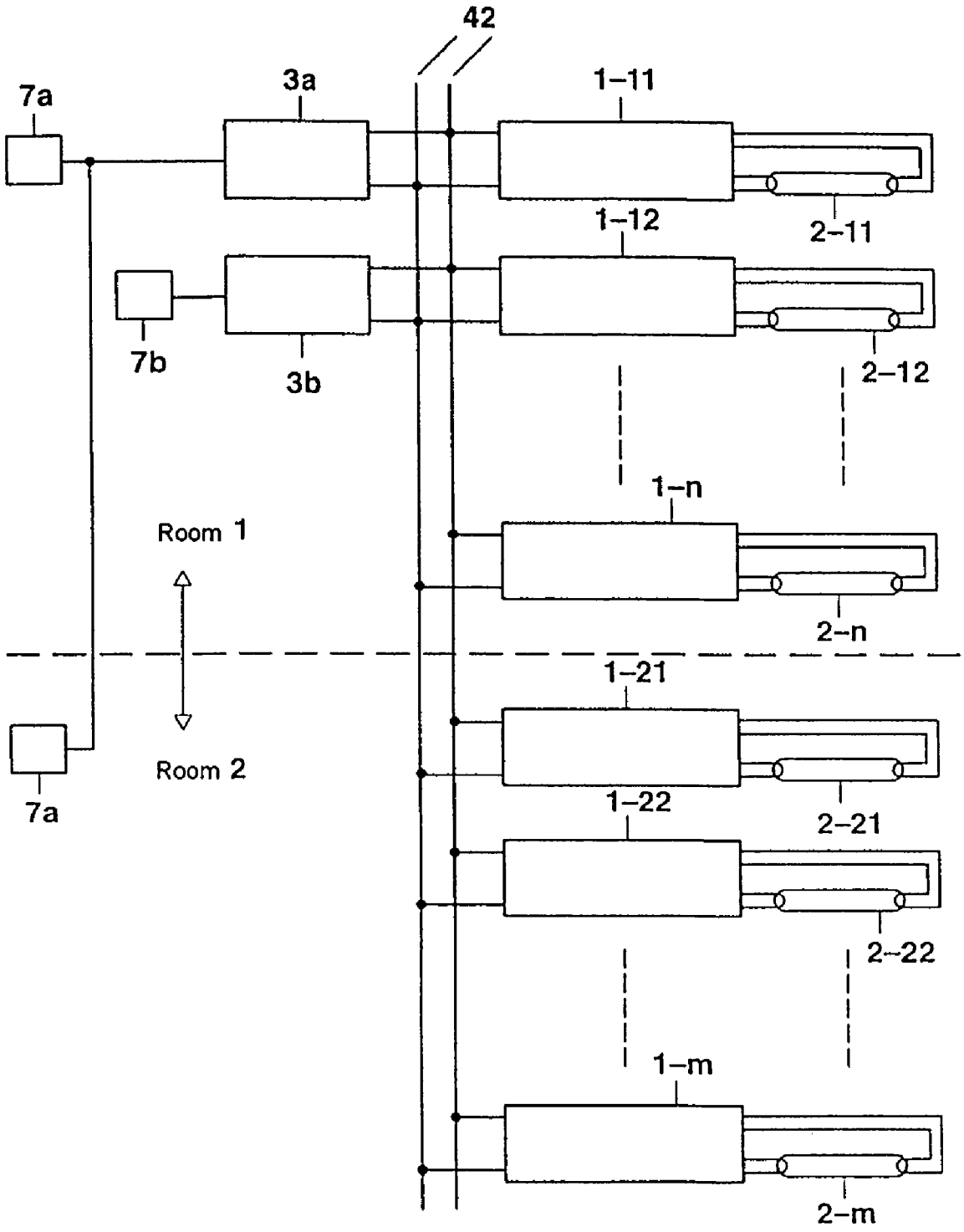
FIG. 2 shows, schematically, a lighting system according to the invention.
Figure 3:
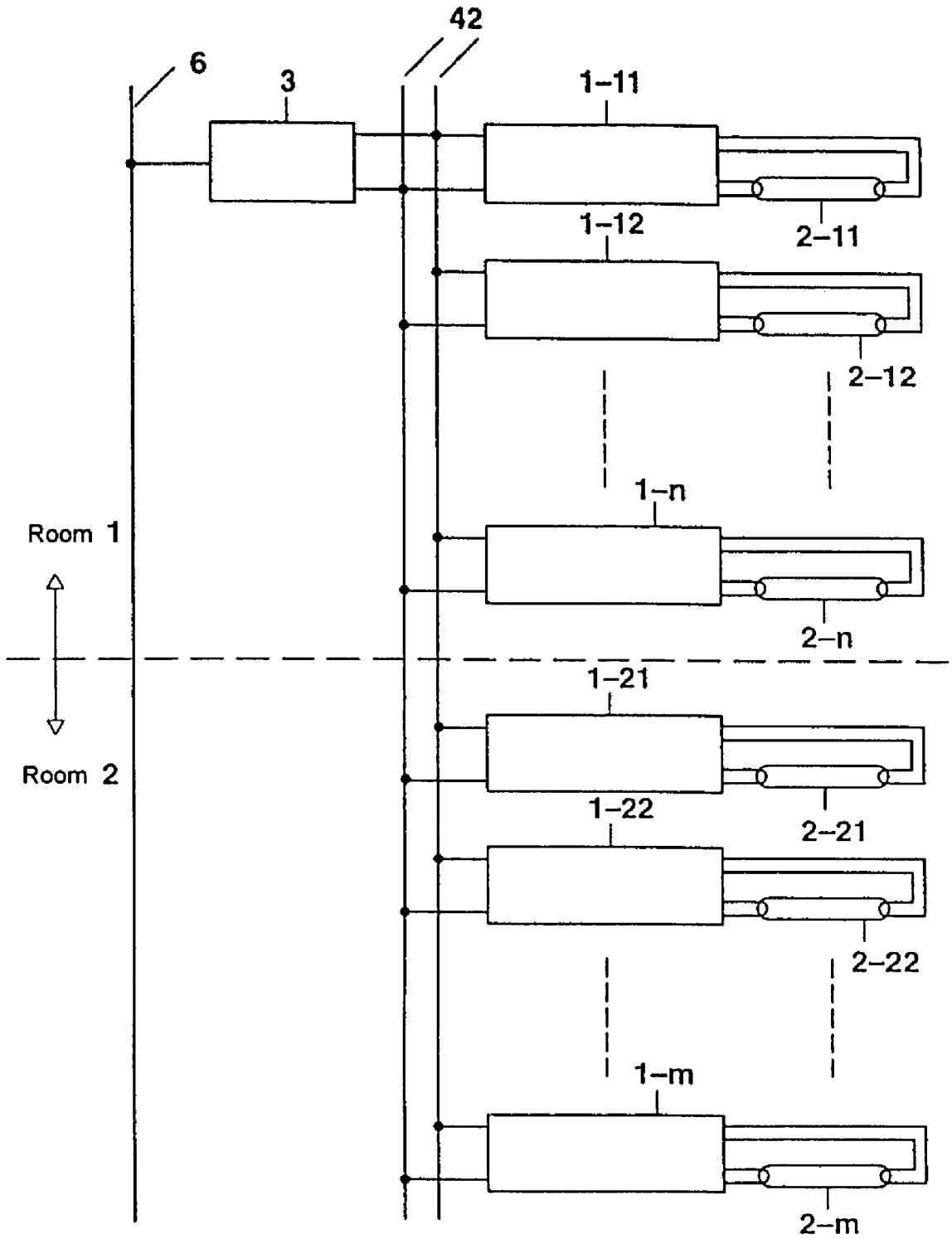
FIG. 3 shows a second exemplary embodiment of a lighting system according to the invention.

FIG. 3 shows an alternative to FIG. 2, with identical reference numbers denoting corresponding elements. The difference from the embodiment shown in FIG. 2 is in that in this case one controller 3 is used for inputting control commands to the control signal line 42, and itself receives commands via a bus system in the form of a symbolic cable 6 for a more general building control system. The controller 3 thus in this case denotes the interface or the gateway between the building control system which is illustrated by the cable 6 on its left and the actual lighting system, which starts with the controller 3. The design of the building control system and in particular the command input are not illustrated in any more detail here; this is merely to demonstrate that the lighting system according to the invention can be integrated in a system such as this.

Figure 4:
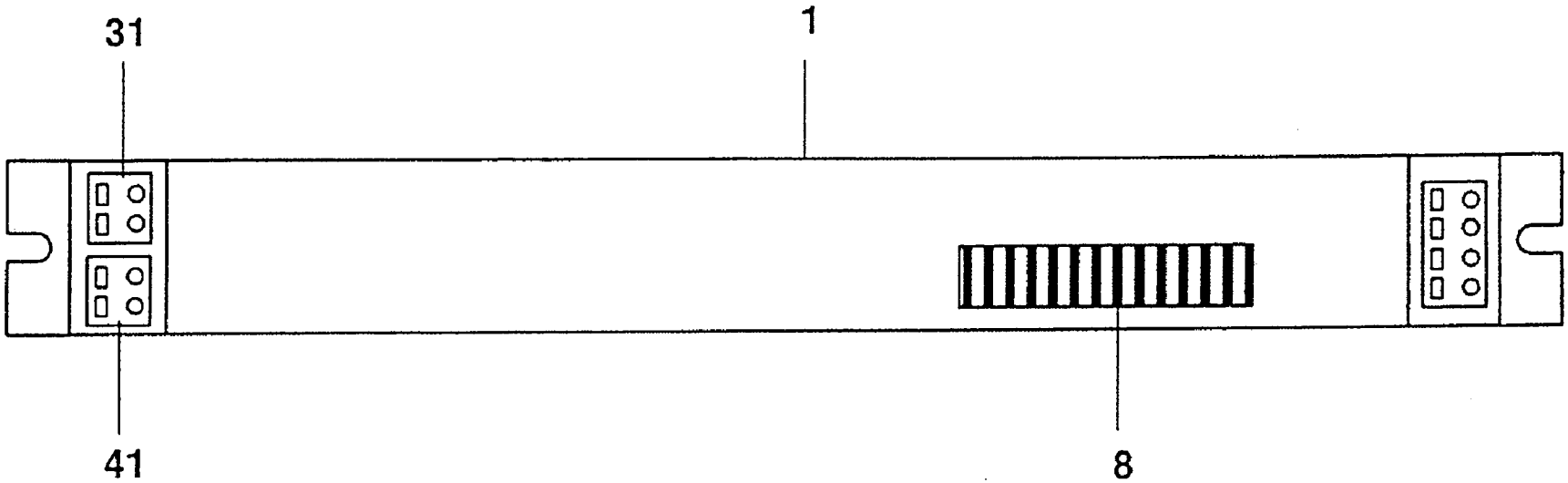
FIG. 4 shows the ballast from FIG. 1, from the outside.

FIG. 4 shows one specific example of an electronic ballast 1 as shown in FIGS. 1–3. A cuboid sheet-metal housing is illustrated here, in which the circuit explained in more detail with reference to FIG. 1 is accommodated. The mains connection 31 and the control connection 41 can be seen on the left; four individual connections for the lamp 2 are shown on the right, but are not annotated. The electronic ballast 1 may easily be fitted in lights via recesses which can be seen on the left and right on the outside.

In particular, the electronic ballast 1 shown in FIG. 4 has a barcode 8 printed on it, and the corresponding code is reproduced alphanumerically. This is the individual coding of the individual electronic ballasts as already explained in the introduction to the description, which can be recorded by the fitter during installation of the lighting system shown in FIG. 2 or 3 or on retrofitting the electronic ballast 1 to an existing lighting system, by means of a barcode reader or by typing. The corresponding code is stored in the semiconductor memory 16*a*, as illustrated in FIG. 1, for the microcontroller 16 in the electronic ballast, and reflects the manufacturing location, time and line (in the factory) of the electronic ballast and may also include details about the appliance type, for example about the number of lamp outputs and the lamp types which can be operated.

The fitter can then produce an association, in a correspondingly produced installation plan on paper and/or a corresponding file (reading by a barcode reader or, for example, typing into a notebook) between the position of the individual electronic ballast 1, as predetermined by its installation, in the lighting system as shown in FIG. 2 or FIG. 3 (that is to say whether this is, for example, the electronic ballast 1-12 for the discharge lamp 2-12 for example at the right on the rear on the ceiling of the first room, or the electronic ballast 1-21 for the discharge lamp 2-21, for example on the hall-side wall of the second room) and the code 8, and can make this database available to the programmer for the controllers 3. During programming, the controller or controllers is or are now informed of which electronic ballast code 8 corresponds to which position. The corresponding electronic ballast 1 can then be addressed by signaling by means of the electronic ballast code 8, that is to say it reacts to appropriate commands with the correct code input or outputs the code to the controller in response to a general request. The controller can thus assign internal control addresses to each of the electronic ballasts 1 and codes 8 (in principle, it may also use the existing codes 8 as addresses).

Figure 5A:
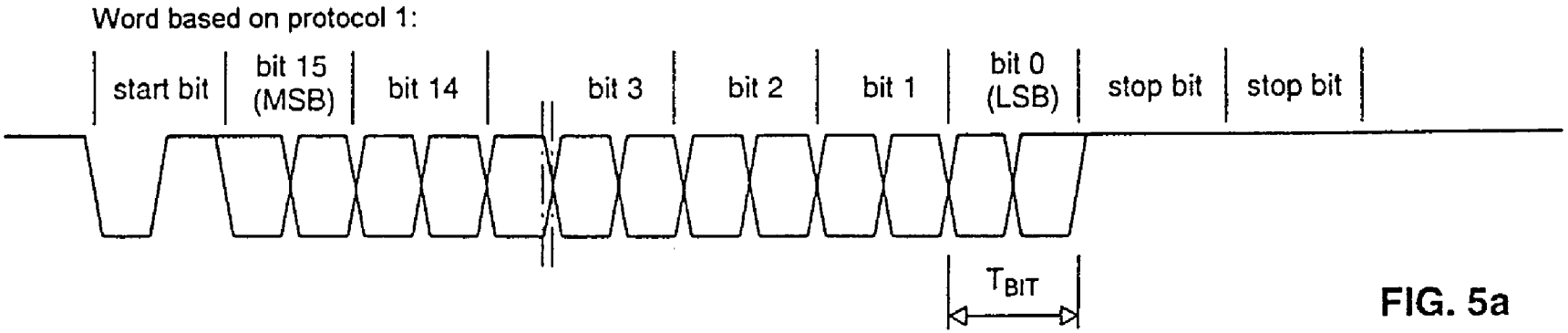
FIGS. 5*a*–5*c* show, schematically, the word layout of control commands according to the invention.
Figure 5B:
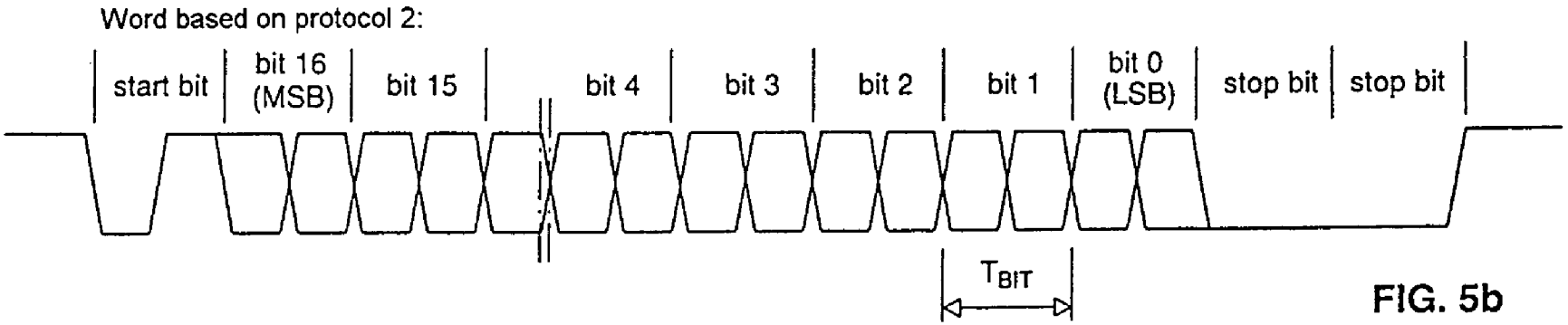
Figure 5C:
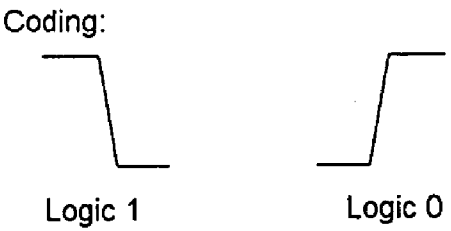

FIGS. 5*a* and 5*b* show, schematically, the word layout (frame) of control commands between the controllers 3 and electronic ballasts 1 based on the two biphase-coded protocols. FIG. 5*c* shows the biphase-coded protocols. The biphase coding is explained in FIG. 5*c*, with the falling edge on the left from the high level to the low level being intended to correspond to the logic level 1, and the complementary rising flank on the right being intended to correspond to logic 0.

In this exemplary embodiment, the upper protocol 1 corresponds to the already mentioned DALI protocol and comprises a start bit (logic 1) as well as 16 subsequent information bits No. 15-0 and, finally, a stop bit, which corresponds to a high level lasting for two bit periods (referred to as $T_{BIT}$). MSB and LSB in this case represent the most significant bit and the least significant bit, respectively.

The second protocol is shown underneath this, that is to say a communication protocol which in the present case is OSRAM-specific, whose start bit corresponds to the DALI protocol 1 but which has a word length that is lengthened by 1 bit and has an inverted-level stop bit. The electronic ballasts 1 can thus unambiguously determine both from the word length and from the nature of the stop bit whether this is a DALI command or an OSRAM-specific command.

In particular, this makes it possible to carry out manufacturer-specific additional commands or checks, as well as programming processes in the illustrated lighting systems, independently of the functioning and operation of the DALI communication between the controllers 3 and electronic ballasts 1.

Figure 6:
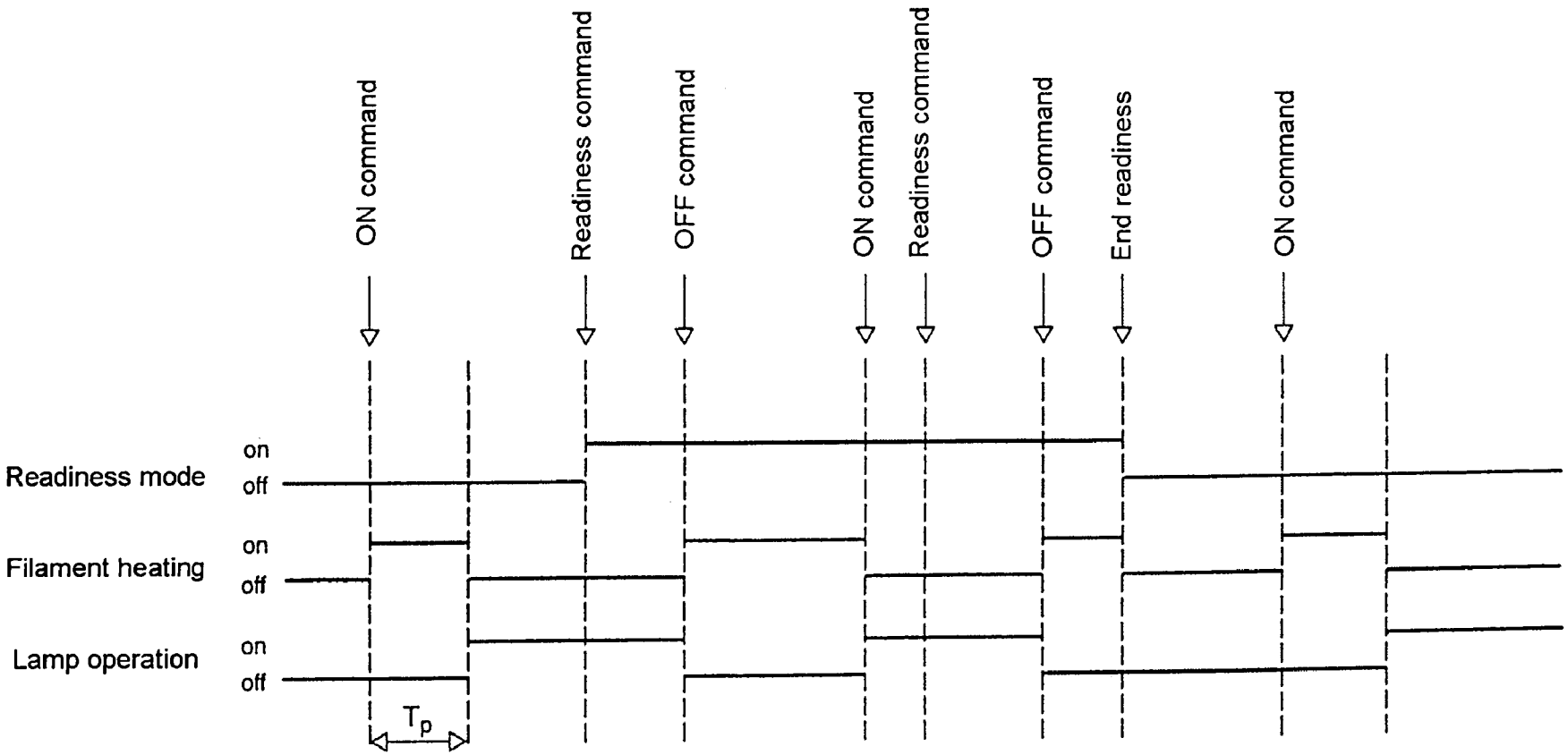
FIG. 6 shows schematic timing diagrams in order to explain the readiness state according to the invention.

Finally, FIG. 6 shows one of the various usage options for the additional communication protocol, namely with a manufacturer-specific readiness command. The meanings of the horizontally running diagram lines are shown on the left, with a high line level corresponding to "being switched on" and a low line level corresponding to "being switched off". In the illustrated diagram, the timing, which runs from left to right, thus starts with the readiness mode being switched off.

Starting from the left, an on command first of all results in a filament preheating state for the time $T_p$, which is followed by starting and thus lamp operation (the lowermost horizontal line in the diagram suddenly changes to "on"). A readiness command according to the invention (the top line changes suddenly to "on") is produced during lamp operation, which now continues for a certain time, and initially this does not change the lamp operation per se. However, it means that the following off command (which will follow after a time which is once again undefined but does not exceed a specific maximum period) still leads on the one hand to lamp operation being ended, but on the other hand also leads to the filament heating being switched on again at the same time. If a new on command is now produced after a certain time, once again not beyond a certain maximum time, then, in contrast to the first on command (at the extreme left), the lamp can be started again immediately, without having to wait for a new preheating phase $T_p$.

In the illustrated example, a new readiness command is produced while the lamp is switched on and once again leads to a transition to the readiness state, that is to say filament heating, after the next off command and the simultaneous end of lamp operation. However, in this example, the readiness state, that is to say the filament heating, is intended to end after a further specific time, either because a time interval which is greater than a specific predetermined maximum time has elapsed since the readiness command or since the off command, or because a command has been received to end the readiness state. The filament heating is thus switched off. In consequence, filament preheating must once again be carried out, as shown on the extreme right, when the next on command occurs.

Thus, overall, the lighting system is able to allow the lamp to be restarted immediately, with virtually no time delay, by selecting a readiness state by means of the readiness command which is provided by the second protocol. This is an advantageous factor of lighting systems according to the invention, particularly in the field of effect lighting.

What is claimed is:

1. A ballast for a discharge lamp with preheatable electrodes, which ballast is designed to receive as an input a readiness command from a controller, the ballast being arranged and constructed to operate the discharge lamp in such a way that the electrodes are heated further if the discharge lamp is not burning, wherein the controller uses a switch-on command to reignite the discharge lamp, whose electrodes are heated, without delay by means of a preheating time.

2. A controller for a lighting system having discharge lamps with preheatable electrodes, which controller is constructed and arranged to generate as an output a readiness command to a ballast of the discharge lamp, in response to which the ballast drives the discharge lamp in such a way that it heats the electrodes further if the discharge lamp (2) is not burning, wherein the controller uses a switch-on command to reignite the discharge lamp, whose electrodes are heated, without delay by means of a preheating time.

3. A lighting system, comprising:

lamps for light production, at least one of which is a gas discharge lamp with preheatable electrodes;

a ballast which is connected to said discharge lamp; and a controller which controls the at least one ballast by means of signaling commands;

wherein the ballast is designed to receive as an input a readiness command from the controller, the ballast being arranged and constructed to operate the discharge lamp in such a way that the electrodes are heated further if the discharge lamp is not burning; and wherein the controller is constructed and arranged to generate as an output the readiness command to the ballast, the controller being constructed and arranged to use a switch-on command to reignite the discharge lamp, whose electrodes are heated, without delay by means of a preheating time.

4. The lighting system as claimed in claim 3, wherein the lighting system is constructed to be suitable as an illumination system for indoor illumination.

* * * * *